US008885858B2

(12) United States Patent
Nielsen

(10) Patent No.: US 8,885,858 B2
(45) Date of Patent: Nov. 11, 2014

(54) MODULAR HEARING INSTRUMENT

(75) Inventor: Henrik Nielsen, Roskilde (DK)

(73) Assignee: GN Resound A/S, Ballerup (DK)

( * ) Notice: Subject to any disclaimer, the term of this patent is extended or adjusted under 35 U.S.C. 154(b) by 1018 days.

(21) Appl. No.: 12/810,781

(22) PCT Filed: Dec. 22, 2008

(86) PCT No.: PCT/DK2008/000450

§ 371 (c)(1),
(2), (4) Date: Sep. 28, 2010

(87) PCT Pub. No.: WO2009/083008

PCT Pub. Date: Jul. 9, 2009

(65) Prior Publication Data

US 2011/0019849 A1 Jan. 27, 2011

Related U.S. Application Data

(60) Provisional application No. 61/017,093, filed on Dec. 27, 2007.

(30) Foreign Application Priority Data

Dec. 27, 2007 (DK) ..... 2007 01878

(51) Int. Cl.
*H04R 25/00* (2006.01)

(52) U.S. Cl.
CPC ..... *H04R 25/608* (2013.01); *H04R 25/75* (2013.01); *H04R 2225/021* (2013.01); *H04R 25/604* (2013.01); *H04R 2460/09* (2013.01); *H04R 25/652* (2013.01); *H04R 25/453* (2013.01); *H04R 25/65* (2013.01); *H04R 2225/025* (2013.01); *H04R 2225/63* (2013.01); *H04R 25/658* (2013.01); *H04R 25/558* (2013.01); *H04R 25/654* (2013.01); *H04R 25/405* (2013.01); *H04R 25/656* (2013.01); *H04R 25/602* (2013.01)
USPC ..... 381/322; 381/312; 381/328

(58) Field of Classification Search
USPC ..... 381/312, 322–324, 328, 370, 374, 379, 381/380; 181/130, 135; 379/430
See application file for complete search history.

(56) References Cited

U.S. PATENT DOCUMENTS 3,527,901 A 9/1970 Geib
4,553,627 A 11/1985 Gastmeier
(Continued)

FOREIGN PATENT DOCUMENTS

CN 101094760 A 12/2007
DE 29718503 10/1997
(Continued)

OTHER PUBLICATIONS

International Search Report and Written Opinion dated Apr. 21, 2009 for International Application No. PCT/DK2008/000450.
(Continued)

*Primary Examiner* — Matthew Eason
(74) *Attorney, Agent, or Firm* — Vista IP Law Group, LLP

(57) ABSTRACT

A set of hearing instrument parts includes a trunk part that is selectively placeable in a left ear canal or a right ear canal or a user, an elongate member having a first end and a second free end, a left ear connector configured to connect the trunk part and the elongate member to form a first configuration that is suitable for a left ear of the user, and a right ear connector configured to connect the trunk part and the elongate member to form a second configuration that is suitable for a right ear of the user, wherein the elongate member is configured for placement in a pinna for retention of the trunk part in a selected one of the left ear canal and the right ear canal.

25 Claims, 14 Drawing Sheets

(56) References Cited

U.S. PATENT DOCUMENTS

Figure 1:
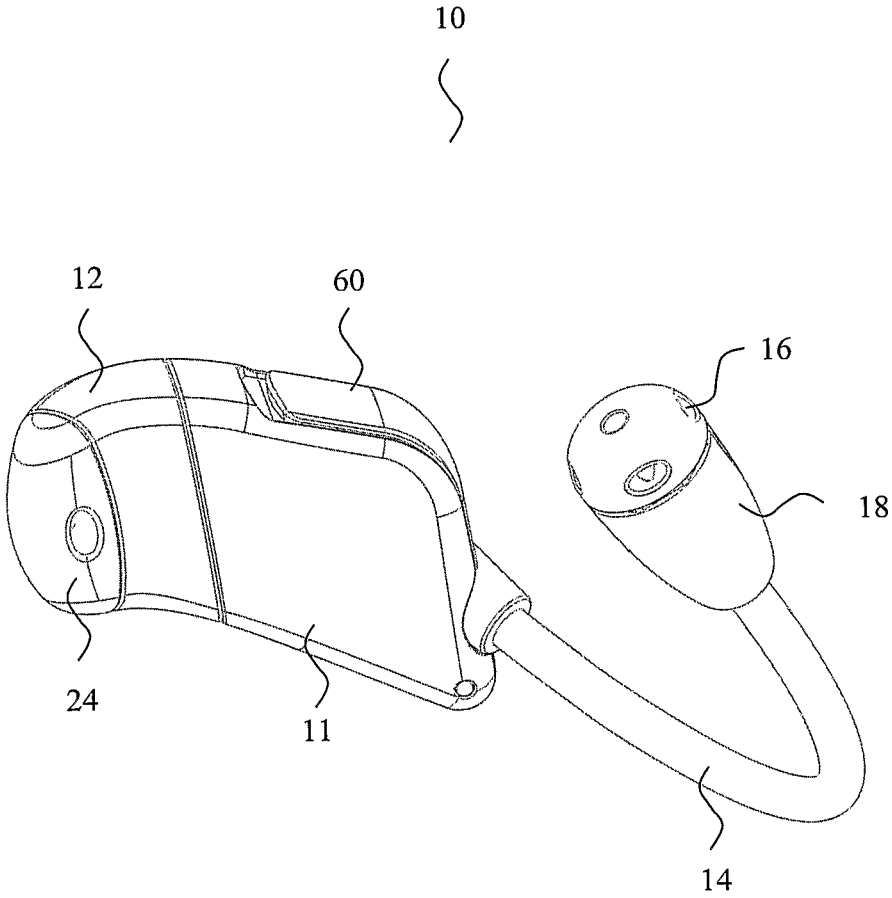

| | | | | |
|---|---|---|---|---|
| 5,048,090 | A * | 9/1991 | Geers | 381/328 |
| 5,403,262 | A | 4/1995 | Gooch | |
| 5,619,580 | A | 4/1997 | Hansen | |
| 5,654,530 | A | 8/1997 | Sauer | |
| 5,680,467 | A | 10/1997 | Hansen | |
| 6,389,143 | B1 | 5/2002 | Leedom et al. | |
| 6,498,858 | B2 | 12/2002 | Kates | |
| 2001/0051776 | A1 | 12/2001 | Lenhardt | |
| 2004/0047483 | A1 | 3/2004 | Bauman | |
| 2004/0131200 | A1 | 7/2004 | Davis | |
| 2006/0159298 | A1 | 7/2006 | von Dombrowski et al. | |

FOREIGN PATENT DOCUMENTS

| | | | |
|---|---|---|---|
| EP | 1811808 | A | 7/2007 |
| EP | 1816894 | | 8/2007 |
| GB | 2134689 | | 8/1984 |
| GB | 2305067 | | 3/1997 |
| WO | 9700593 | | 1/1997 |
| WO | 9904601 | A | 1/1999 |
| WO | 0076271 | | 12/2000 |
| WO | 0108443 | A | 2/2001 |
| WO | 0149070 | | 7/2001 |
| WO | 0203757 | A | 1/2002 |
| WO | 02052890 | | 7/2002 |
| WO | 03030772 | | 4/2003 |
| WO | 2004010734 | | 1/2004 |
| WO | 2006026988 | A | 3/2006 |
| WO | 2006056198 | A | 6/2006 |
| WO | 2006056198 | A2 | 6/2006 |
| WO | 2007014950 | | 2/2007 |

OTHER PUBLICATIONS

International-Type Search Report dated Jun. 12, 2008 for DK App No. PA 200701878.

Danish Office Action dated Jul. 11, 2008 for DK App No. PA 200701878.

Novelty Search Report dated Nov. 16, 2007 from Swedish Patent and Registration Office.

Del Bo et al. "Using Open-Ear Hearing Aids in Tinnitus Therapy", Hearing Review, Aug. 2006.

Pawel J. Jastreboff, "Tinnitus Habituation Therapy (THT) and Tinnitus Retraining Therapy (TRT)", Tinnitus Handbook, pp. 357-376, Year 2000.

Chinese Office Action dated Dec. 13, 2012, for Chinese Patent Application No. 200880126764.8.

Chinese Official Decision of Rejection dated Aug. 13, 2013, for Chinese Patent Application No. 200880126764.8.

* cited by examiner

A

B

MODULAR HEARING INSTRUMENT

RELATED APPLICATION DATA

This application is the national stage of International Application No. PCT/DK2008/000450, filed on 22 Dec. 2008, which claims priority to and the benefit of U.S. Provisional Patent Application No. 61/017,093, filed on 27 Dec. 2007, and Danish Patent Application No. PA 2007 01878, filed on 27 Dec. 2007, the entire disclosure of all of which is expressly incorporated by reference.

FIELD

The present application relates to a new type of hearing instrument with a housing that is adapted for positioning in the ear canal of a user having an elongate member for positioning outside the ear canal in the pinna. In particular the present application relates to a set of hearing instrument housing parts for selection and assembly into a hearing aid housing fitting a specific user. The hearing instrument may be a hearing aid, a tinnitus relieving device, a tinnitus therapy device, a noise suppression device, etc., or any combination of two or more of such devices.

BACKGROUND AND SUMMARY

A conventional in the ear (ITE) or completely-in-the-canal (CIC) hearing aid has a housing that is custom made to individually fit the user's ear canal. The hearing aid components, e.g. electronics, microphone, receiver, battery, etc., are contained in the housing which is closed by a faceplate at the end pointing away from the ear canal. In order to reduce occlusion, a so-called vent, i.e. a ventilation channel, is provided for communication between an opening in the faceplate and the user's ear canal. The vent may be drilled through the housing or shell, or a pipe or tube extending within the hearing aid and connecting an opening in the faceplate with an opening at the opposite end of the housing may constitute the vent. The effectiveness of the vent is increased by increasing the cross-section and decreasing the length of the vent channel.

Behind-the-ear (BTE) hearing aids in which a sound tube conducts sound generated by the receiver of the hearing aid into the ear canal are also well known in the art. In order to position the sound tube securely and comfortably in the ear canal, an earpiece is provided for insertion into the ear canal of the user.

Typically, the ITE or CIC housing or the BTE earpiece is individually custom manufactured to fit precisely in the ear canal of the user without causing pain to the user while still retaining the housing or earpiece securely in place in the ear canal preventing the earpiece from falling out of the ear irrespective of movements of the user, such as chewing or yawning, and also avoiding acoustical feedback generating unpleasant and annoying whistling or howling. The custom made earpiece adds to the cost of the hearing aid and the time needed to fit the hearing aid.

Typically, customized hearing aids are made from solid materials to secure retention and tightness. These hearing aids are placed completely or partially in the ear canal. Since the walls of the ear canal are moving when the jaws move for instance when chewing, the placement of such solid hearing aids in the ear canal can be associated with discomfort for the user.

Several approaches to eliminate this discomfort have been tried, one such approach is to make the canal portion of the device in a soft material, e.g. as disclosed in WO 02/03757 A1. Such devices are complicated to manufacture and will only offer limited venting.

In WO 2004/010734, a canal hearing device is disclosed having a dual acoustic seal system for preventing feedback while minimizing occlusion effects. The two-part device comprises a main module and an elongated tubular insert for conducting sound to the eardrum and sealing within the bony region of the ear canal. The main module is positioned in the cartilaginous portion of the ear canal. The tubular insert comprises a sound conduction tube and a cylindrically hollow primary seal medially positioned in the bony region. The device also comprises a secondary seal laterally positioned in the cartilaginous region.

WO 01/08443 discloses a one-size-fits-all hearing aid, which is adapted to fit into either ear of an ear canal of a user to a depth proximal to the tympanic membrane. The hearing aid is comprised of two half shells joined together to house the hearing aid components. The joined shells secure a flexible tip at the distal end of the shell.

According to a first aspect of some embodiments, a set of hearing instrument housing parts is provided, comprising a trunk part shaped for accommodation in the ear canal of a user and configured for interconnection with a left ear connector configured to be attached to the trunk part and to be attached to a first end of an elongate member having an opposite second free end in such a way that the elongate member forms an angle with the longitudinal extension of the trunk part, when operatively interconnected with the trunk part, the angle being suitable for use in the left ear of the user, and a right ear connector configured to be attached to the trunk part and to be attached to the first end of the elongate member having the opposite second free in such a way that the elongate member forms an angle with the longitudinal extension of the trunk part, when operatively interconnected with the trunk part, the angle being suitable for use in the right ear of the user, the elongate member being configured for interconnection with a selected one of the left ear connector and the right ear connector and for positioning outside the ear canal in the pinna for retention of the trunk part in the ear canal.

Retention of the hearing instrument in the proper place is important. Jaw movements can exert outward forces on parts of the hearing instrument housing that reside in the ear canal during use. Preferably, the elongate member has sufficient resilience to counteract this force thereby securing parts of the hearing instrument housing residing in the ear canal from outward motion.

The elongate member may be adapted to be positioned in the pinna of the user around the circumference of the conchae abutting the antihelix and at least partly covered by the antihelix for retainment of its position.

The elongate member may be preformed during manufacture, preferably into an arched shape with a curvature slightly larger than the curvature of the antihelix, for easy fitting of the elongate member into its intended position in the pinna.

The elongate member may be resilient for assisting in retaining the trunk part of the housing in the ear canal of the user so that the trunk part of the housing remains securely in place in the ear canal without falling out of the ear irrespective of movements of the user, such as smiling, chewing or yawning. Retention is provided without causing pain to the user.

Preferably, the elongate member is resilient in a direction perpendicular to its longitudinal extension thereby providing further capability of retention of the trunk part of the housing in the ear canal of the user. During positioning of the trunk part of the housing in its intended position in the ear canal of the user, the transverse resilience of the elongate member facilitates insertion of the trunk part of the housing into the ear canal of the user.

The elongate member may further be adapted to abut part of the concha at the antitragus when the trunk part of the housing has been inserted in the ear canal thereby applying a force to the trunk part of the housing towards an upper part of the ear canal and thereby retaining the trunk part of the housing in a position in which the trunk part of the housing is pressed against the wall of the upper part of the ear canal. The upper part of the ear canal remains relatively unaffected during jaw movement so that parts of the housing resting against the upper part of the ear canal wall are subjected to the least possible outward moving forces during jaw movement.

Preferably, the elongate member is adapted to abut the antihelix and extend at least to the inferior crus of the antihelix when the trunk part of the housing is positioned in the ear canal of the user.

More preferred the elongate member is adapted for positioning of the second end at the cimba concha below the triangular fossa of the ear of the user when the trunk part of the housing is positioned in the ear canal of the user.

The elongate member may be adapted for accommodation of a microphone. For example, the elongate member may be adapted for accommodation of the microphone at its second end. The elongate member may have a larger cross-section at its second end accommodating the microphone than a remaining part of the elongate member extending therefrom and towards the first end.

Positioning of the microphone of a hearing aid at the second end of the elongate member provides a large distance between the microphone and the hearing aid receiver thereby minimizing feedback.

Feedback limits the maximum gain available to the user of the hearing aid. Feedback refers to the amplified signal returning to a hearing aid input. The feedback path may be an acoustic feedback path of sound propagating from the receiver along a path outside the hearing instrument to the microphone. This phenomenon, which is also known as acoustical feedback, occurs e.g. when a hearing instrument housing does not completely fit the wearer's ear, or in the case of a housing comprising a so-called vent, i.e. a canal or opening for e.g. ventilation purposes. In both examples, sound may "leak" from the receiver to the microphone and thereby cause feedback.

Additionally, inductive feedback may occur in the hearing aid, for example via a telecoil of the hearing aid coupling a magnetic field generated by the receiver into the telecoil thereby generating a hearing aid input signal.

Oscillation may arise when the attenuation provided by the feedback path is smaller than the hearing aid gain. A large distance between the microphone and the receiver alleviates this problem.

However, feedback in a hearing instrument may also occur internally since sound can be transmitted from the receiver to the microphone via a path inside the hearing instrument housing. Such transmission may be airborne or caused by mechanical vibrations in the hearing instrument housing or some of the components within the hearing instrument. In the latter case, vibrations in the receiver are transmitted to other parts of the hearing instrument, e.g. via the receiver mounting(s). For this reason, the receiver is for example not fixed but flexibly mounted within some state-of-the-art hearing aids of the ITE-type (In-The-Ear), whereby transmission of vibrations from the receiver to other parts of the device is reduced.

While the problem of external feedback limits the maximum gain available in a hearing aid while in use by a hearing impaired wearer, the problem of internal feedback has its main implications in the production process of hearing instruments, where it is today a very time-consuming manual procedure to mount and/or place receiver and microphone(s) in the devices in such a way that internal feedback is minimised.

The continuing minimisation of the size of a hearing aid makes it more and more critical to accurately position the receiver in the hearing aid housing during manufacture or service so that internal feedback is kept at a minimum. This also makes the hearing aid less robust against bumps or impacts against the surroundings that may occur during use of the hearing aid, since a slight displacement of the receiver may cause sufficient internal feedback to significantly reduce the maximum gain made available to the user without howling or whistling of the hearing instrument.

Thus, the long distance provided between the receiver and the microphone in the present housing makes positioning of the receiver easy to perform during manufacture or service and robust during use without reducing the maximum gain made available to the user of the hearing instrument.

Further, the long distance makes it possible to mount the receiver in close contact with the hearing instrument housing, since the internal mechanical and/or acoustical feedback will be suppressed due to the long distance between receiver and microphone. Thus, the previously required suspension of the receiver in resilient suspensions within the hearing instrument is no longer necessary. The receiver may be snugly fitted within the hearing instrument housing, e.g. within a compartment of the hearing instrument housing having mechanical support elements abutting the hearing instrument when mounted and keeping the receiver in a specific position during use. The mounting of the receiver is thereby made robust against mechanical bumps or impacts that the hearing instrument will experience during transport or use. Further, the manufacture of the hearing instrument is simplified and less costly and makes it easy to calibrate.

Further, absence of specific receiver mountings makes more volume available inside the hearing instrument housing for a larger receiver so that the present hearing instrument housing is capable of accommodating a larger receiver than can be accommodated inside similar sized conventional hearing instrument housings. Thus, the present hearing instrument housing with a microphone in the elongate member is capable of providing a larger gain than provided by similar sized conventional hearing instrument housings.

The internal feedback signal path between the microphone and the receiver may comprise a mechanical connection, an acoustical connection, or a combined mechanical and acoustical connection.

Here, the term acoustical refers to sound propagating as pressure waves in a gas, such as ordinary air within the hearing aid, while the term mechanical refers to sound propagating as vibrations through solid materials, such as the hearing instrument housing, receiver/microphone mountings etc.

Thus, the internal feedback signal path may comprise mechanical elements in the hearing aid, such as receiver, microphone, mountings and housing, and in some cases, also an acoustical element, such as air within the hearing instrument housing.

The external feedback signal path is typically an acoustic path between the microphone and the receiver, i.e. an external feedback signal propagates through air surrounding the hearing aid.

As further described below, electronic feedback suppression may also be provided in the hearing instrument according to some embodiments.

The elongate member may accommodate further electrical hearing instrument components.

In an elongate member with a microphone at the second end of the elongate member, the elongate member is preferably substantially rigid in the direction of its longitudinal extension so that electrical conductors residing in the elongate member are protected against breaking.

With a microphone in the elongate member at its second end, localisation is substantially maintained when the microphone is positioned at a location within the pinna wherein the microphone receives a sound signal that allows the user to perceive the direction towards a sound source. Then, the sound signal based on which the user is capable of perceiving direction is transmitted to the ear drum of the user by the hearing aid. For example, sense of direction may be substantially maintained when the microphone is positioned at the cimba concha below the triangular fossa in the pinna.

Two microphones may be accommodated at the second end of the elongate member for provision of noise suppression and/or further directionality.

The elongate member and the trunk part preferably form separate units that are manufactured in separate pieces. The trunk part of the housing and the elongate member may be interconnected mechanically and possibly electrically via the left ear connector or the right ear connector during manufacture of the hearing instrument, or they may be interconnected at a later stage, e.g. by the dispenser during fitting of the hearing instrument to a user.

The elongate member according to some embodiments is preferably manufactured in a number of standard sizes to fit the human anatomy of the pinna of most users. In this way, the manufacturing cost is lowered as compared to the manufacturing cost of customized elongate members.

The present hearing instrument housing is preferably manufactured in a number of standard sizes to fit the human anatomy of the ear canal of most users. In this way, the manufacturing cost is lowered as compared to the manufacturing cost of customized housings. Various standard sizes may also be provided for accommodation of batteries of different sizes, and various standard sizes may be provided for accommodation of receivers of different sizes.

In a preferred embodiment, the elongate member is removably interconnected with the trunk part of the housing so that a large number of different models of the hearing aid may be provided by combining elongate members of different standard sizes with a standard sized trunk part possibly selected from a set of differently sized trunk parts.

The left ear connector may be configured to be removably attached to the trunk part. Further, the right ear connector may be configured to be removably attached to the trunk part.

The housing may comprise a battery door providing access to a battery compartment for accommodation of a non-rechargeable battery. The elongate member may be attached to the battery door and the battery door may be removably attached to the trunk part of the housing with the right ear connector or the left ear connector included in the battery door for removal of the elongate member from the trunk part together with the battery door.

The battery door with the elongate member may be manufactured in one shape suitable for the right ear and another shape suitable for the left ear. In the shape suitable for the right ear, the elongate member extends from the battery door at a certain angle with relation to the battery door suitable for positioning of the elongate member in the pinna of the right ear when the trunk part has been inserted into the right ear canal of the user. In the shape suitable for the left ear, the elongate member extends from the battery door at a certain angle with relation to the battery door suitable for positioning of the elongate member in the pinna of the left ear when the trunk part has been inserted into the left ear canal of the user.

The connector may further be adapted for making electrical contact with a signal line in the elongate member when the battery door is attached to the housing.

Preferably, the hearing instrument housing provides an open solution. In accordance with hearing aid terminology, a hearing instrument with a housing that does not obstruct the ear canal when the housing is positioned in its intended operational position in the ear canal; is categorized "an open solution". The term "open solution" is used because of the passageway between a part of the ear canal wall and a part of the housing allowing sound waves to escape from behind the housing between the ear drum and the housing through the passageway to the surroundings of the user. With an open solution, the occlusion effect is diminished and preferably substantially eliminated.

A user being fitted with a conventional hearing aid experiences an altered perception of his or her voice mainly due to occlusion of the ear canal by the housing or earpiece. The user typically describes the sound of his or her voice in one of the following terms: "My voice echoes", "My voice sounds hollow" or "I sound like I'm talking in a barrel".

Sounds originating from the vocal tract (throat and mouth) are transmitted into the ear canal through the cartilaginous tissue between these cavities and the outer portion of the ear canal.

When nothing is positioned in the ear canal, most of this predominantly low frequency sound simply escapes from the ear canal. However, when the ear canal is blocked these bone-conducted sounds cannot escape from the ear canal. The result is a build-up of high sound pressure levels in the residual ear canal volume. This increase in low frequency sound pressure is audible and will cause them to hear their own voice as loud and boomy. Change in perception of own voice is the most dominant occlusion related complaint, but not the only one. Other occlusion related problems include too much amplification at low frequencies for hearing aid users with good low frequency hearing, reduced speech intelligibility, poorer localization, physical discomfort and increased risk of external ear irritation and infection. Hearing aid users do not adapt to occlusion and the occlusion effect has been cited by as many as 27% of hearing aid wearers as a reason for dissatisfaction with their hearing aids. This emphasizes the need for alleviating or, even better, eliminating the occlusion effect.

Thus, preferably, the trunk part and possible further parts of the housing residing in the ear canal during use have a cross-section that is smaller than the cross-section of the ear canal so that occlusion substantially does not occur. When the housing is inserted into the user's ear canal, the smaller cross-section of the trunk part and possible further parts of the housing allows communication between the ear canal between the eardrum and the housing and the surroundings for prevention of occlusion.

The trunk part is preferably substantially straight along its longitudinal extension.

Preferably, the trunk part has a substantially rectangular cross-section perpendicular to its longitudinal extension.

Preferably, the trunk part has a substantially rectangular cross-section extending in parallel with its longitudinal extension.

The trunk part may further comprise a connector configured for making electrical contact with a signal line in the elongate member when the elongate member is attached to the trunk part.

The size and shape of the ear canal vary among individuals. Typically, the ear canal is approximately 26 mm long and 7 mm in diameter. In most cases, the ear canal bends backwards and slightly upward in the medial direction, i.e. in the direction from the entrance of the ear canal towards the ear drum. Thus, a right tip part of the hearing instrument housing fitting into the right ear canal of the user is preferably provided that forms an angle towards the left with relation to the longitudinal extension of the trunk part when seen from above in the medial direction of the ear canal. Further, a left tip part fitting into the left ear canal of the user is preferably provided that forms an angle towards the right with relation to the longitudinal extension of the trunk part when seen from above in the medial direction of the ear canal. Individuals with a straight ear canal requiring a straight tip part are rare.

The set of hearing instrument housing parts may further comprise a right tip part that forms an angle with relation to the longitudinal extension of the trunk part when operatively interconnected with the trunk part, facilitating accommodation in the right ear canal of the user of a hearing instrument housing comprising the interconnected trunk part and right tip part, and a left tip part that forms an angle with relation to the longitudinal extension of the trunk part when operatively interconnected with the trunk part, facilitating accommodation in the left ear canal of the user of a hearing instrument housing comprising the interconnected trunk part and left tip part, the trunk part being further configured for interconnection with a selected one of the left tip part and the right tip part.

The set of hearing instrument housing parts may further comprise a straight tip part that is straight and extends along the longitudinal extension of the trunk part when operatively interconnected with the trunk part.

Tip parts may be manufactured in a number of standard sizes and shapes, e.g. in a number of angles formed with relation to the longitudinal extension of the trunk part when assembled with the trunk part, and in a number of lengths, widths and heights, and in a number of angular depths, i.e. distances from the interconnection between the tip part and the trunk part to the bend of the tip part, etc., for accommodation in respective ear canals of different sizes and with bends occurring at different depths in the ear canal and with different bending angles.

The tip part of the housing may be flexible for variation of the angle for increased wearing comfort.

The tip part may be customized to individually fit the user's ear canal without causing pain to the user while still retaining the housing securely in place in the ear canal preventing the housing from falling out of the ear irrespective of movements of the user, such as smiling, chewing or yawning.

Since the customized tip part accurately fits the shape of the ear canal, the internal volume of the tip is defined by the shape of the ear canal at the intended position of the tip part in the ear canal. Thus, in the intended position, the largest possible volume is provided for accommodation of the receiver whereby insertion into a narrower ear canal than would have been possible with a standard sized tip part is made possible. Alternatively, accommodation of a larger receiver than the receiver in a standard sized tip part may be possible in a customized tip part. Therefore, the customized tip part facilitates larger sound amplification. This is further supported by the tight fitting of the customized tip part to the ear canal wall preventing sound pressure leakage around the tip part and thus, making formation of large sound pressures possible. Further, the tight fit suppresses external feedback.

Additionally, conventional customized CIC or ITE hearing aid housings have a large contact surface with the surface of the ear canal when mounted in the ear canal. Most of the surface of the housing of a conventional customized CIC or ITE hearing aid accurately fits the ear canal of a user and therefore, the surface of the housing is in close contact with the ear canal and sometimes part of the concha as well. This large contact area of conventional CIC or ITE hearing aids leads to several inconveniences for the user. For example, humidity cannot escape to the surroundings in a normal way, since the humidity is trapped by the tightly fitted housing. The trapped humidity is inconvenient in it self, but typically also leads to increased temperatures and increased formation of bacteria on the skin surface of the ear canal, which again may lead to infections that have to be treated by a doctor.

Thus, by provision of a hearing instrument housing with a standard sized trunk part and a customized tip part, a hearing instrument housing is provided wherein only the tip part fits sealingly with the ear canal wall and thus, the provided housing has a very small area of contact with the skin surface of the ear canal of the user, and therefore alleviates the above mentioned problems, while at the same time providing the advantages of increased sound amplification discussed above.

The ear canal of a human consists basically of two parts, namely an outer cartilaginous part and an inner bony part. The cartilaginous part of the ear canal is very dynamic and moves considerably together with the mandible bone, when a person moves his or her jaw, for example when smiling, chewing or talking. With the customized tip part, there will be less transmission of movements from the outer cartilaginous part of the ear canal toward the inner bony part that is very touch-sensitive.

The custom tip is preferable manufactured by a standard rapid prototyping process, such as selective laser sintering (SLS) process, stereolithography (SLA) process, etc.

In order to reduce occlusion, a so-called vent, i.e. a ventilation channel, may be provided in the customized tip part for communication between the surroundings and the ear canal volume behind the sealing tip part in the ear canal. The vent may be drilled through the tip part, or a pipe or tube extending within the tip part may constitute the vent. The effectiveness of the vent is increased by increasing the cross-section and decreasing the length of the vent channel. Because of the passageway between the ear canal wall and the trunk part of the housing, the vent is very short and very effective.

Provision of a customized hearing instrument housing by provision of a customized tip part and a standard sized trunk part decreases the manufacturing cost compared to conventional customized hearing instrument housings.

In one embodiment, a custom made part is provided fitting around a standard sized tip part for individually fitting a standard sized housing to a specific user's ear canal.

In one embodiment, a flexible part fitting around a standard sized tip part is provided for improved fitting of the housing to a specific user's ear canal. The flexible part may be provided in a number of standard sizes.

The hearing instrument may further comprise a cerumen filter that is adapted to be fitted on the receiver or on the tip part of the housing with a snap on coupling.

In a preferred embodiment, the set of hearing instrument housing parts comprises one standard sized trunk part fitting a large majority of possible users, however, the set of hearing instrument housing parts may further comprise a plurality of differently sized trunk parts.

The set of hearing instrument housing parts may further comprise a plurality of differently sized receivers.

The set of hearing instrument housing parts may further comprise a plurality of differently sized elongate members.

Thus, typically, a hearing instrument housing for the right ear of a specific user is assembled, e.g. at the point of sale of the hearing instrument, from parts selected for provision of a best fit with the right ear pinna and the right ear canal of the user in question by selection of an appropriately sized trunk part for connection with a right ear connector having the elongate member at an angle suitable for use in the right ear of the user. Further, the selected trunk part may be interconnected with a selected right tip part that forms an angle towards the left in relation to the longitudinal extension of the trunk part when seen from above in the medial direction of the ear canal facilitating accommodation in the right ear canal of the user in question. A hearing instrument housing for the left ear of a specific user is assembled in a similar way.

Preferably, the receiver is accommodated in the tip part of the housing.

The trunk part of the housing may comprise a connector for making mechanical and electrical contact with the receiver. In this way, the receiver may be installed in the hearing instrument housing at the point of sale, e.g. by the dispenser so that the dispenser may be able to offer a variety of models to the user without a need for purchasing and storing a similar variety of hearing instruments.

Preferably, the trunk part accommodates the signal processor of the hearing instrument for generating an audio signal.

The hearing instrument may further comprise a battery or batteries for power supply of the electric components of the hearing instrument. The battery or batteries may be rechargeable or non-rechargeable.

The size and shape of the housing according to some embodiments has proven to be so comfortable that users are able to sleep well with the housing inserted in an ear canal. This makes the housing well suited for use in tinnitus relieving and noise suppression.

In an embodiment, the hearing instrument constitutes a hearing aid comprising a microphone for converting sound into an audio signal, a signal processor for processing the audio signal for compensating a hearing loss, and a loudspeaker that is connected to an output of the signal processor for converting the processed audio signal into a sound signal. Further, the hearing aid comprises a battery for power supply of the electric components of the hearing aid.

In accordance with hearing aid terminology, the loudspeaker is also denoted a receiver throughout the present specification.

The hearing instrument housing may accommodate the above-mentioned hearing aid components including the microphone in a way similar to the housing of a CIC hearing aid.

In an embodiment, the elongate member accommodates the microphone, e.g. at its second end, and the remaining part or parts of the housing accommodate the other components, and signal conductors extend within the elongate member for electrical interconnection of the microphone with other components in the housing.

In a preferred embodiment, electronic feedback compensation is provided. Feedback is a well-known problem in hearing instruments and several systems for suppression and cancellation of feedback exist within the art. With the development of very small digital signal processing (DSP) units, it has become possible to perform advanced algorithms for feedback suppression in a tiny device, such as a hearing aid, see e.g. U.S. Pat. No. 5,619,580, U.S. Pat. No. 5,680,467 and U.S. Pat. No. 6,498,858.

The above mentioned prior art systems for feedback cancellation in hearing aids deal with external feedback, i.e. transmission of sound between the loudspeaker (often denoted receiver) and the microphone of the hearing aid along a path outside the hearing aid device. This problem, which is also known as acoustical feedback, occurs e.g. when a hearing aid earpiece part does not completely fit the users ear, or in the case of an earpiece part comprising a vent. In both examples, sound may "leak" from the receiver to the microphone and thereby cause feedback.

The problem of external feedback limits the maximum gain available in a hearing aid.

Thus, the hearing aid may further comprise a feedback compensation circuit for providing a feedback compensation signal of signals picked up by the microphone by modelling an acoustical and mechanical feedback signal path of the hearing aid, subtracting means for subtracting the feedback compensation signals from the audio signal to form a compensated audio signal, which is input to the signal processor of the hearing aid.

The feedback signal path is typically an acoustic path between the microphone and the receiver, i.e. an external feedback signal propagates through air surrounding the hearing aid.

Preferably, the feedback compensation means comprises an adaptive filter, i.e. a filter that changes its impulse response in accordance with changes in the feedback path.

Both static and adaptive filters are well known to a person skilled in the art of hearing aids, and will therefore not be discussed in further detail here.

Tinnitus is the perception of sound in the human ear in the absence of corresponding external sound(s). Tinnitus is considered a phantom sound, which arises in the auditory system. For example, a ringing, buzzing, whistling, or roaring sound may be perceived as tinnitus. Tinnitus can be continuous or intermittent, and in either case can be very disturbing, and can significantly decrease the quality of life for one who has such an affliction.

Tinnitus is not itself a disease but an unwelcome symptom resulting from a range of underlying causes, including psychological factors such as stress, disease (infections, Menieres Disease, Oto-Sclerosis, etc.), foreign objects or wax in the ear and injury from loud noises. Tinnitus is also a side-effect of some medications, and may also result from an abnormal level of anxiety and depression.

The perceived tinnitus sound may range from a quiet background sound to a signal loud enough to drown out all outside sounds. The term 'tinnitus' usually refers to more severe cases. A 1953 study of 80 tinnitus-free university students placed in a soundproofed room found that 93% reported hearing a buzzing, pulsing or whistling sound. However, it must not be assumed that this condition is normal—cohort studies have demonstrated that damage to hearing from unnatural levels of noise exposure is very widespread.

Tinnitus cannot be surgically corrected and since, to date, there are no approved effective drug treatments, so-called tinnitus maskers have become known. These are small, battery-driven devices which are worn like a hearing aid behind or in the ear and which, by means of artificial sounds which are emitted, for example via a hearing aid speaker into the auditory canal, to thereby psycho acoustically mask the tinnitus and thus reduce the tinnitus perception.

The artificial sounds produced by the maskers are often narrow-band noise. The spectral position and the loudness level of the noise can often be adjusted via for example a programming device to enable adaptation to the individual tinnitus situation as optimally as possible. In addition, so-called retraining methods have been developed, for example tinnitus retraining therapy (Jastreboff P J. Tinnitus habituation therapy (THI) and tinnitus retraining therapy (TRT). In: Tyler R S, ed. Handbook of Tinnitus. San Diego: Singular Publishing; 2000:357-376) in which, by combination of a mental training program and presentation of broad-band sound (noise) near the auditory threshold, the perceptibility of the tinnitus in quiet conditions is likewise supposed to be largely suppressed. These devices are also called "noisers" or "sound enrichment devices". Such devices or methods are for example known from DE 29718 503, GB 2 134 689, US 2001/0051776, US 2004/0131200 and U.S. Pat. No. 5,403,262.

Although present day tinnitus maskers to a certain extent may provide immediate relief of tinnitus, the masking sound produced by them may adversely affect the understanding of speech, partly because S/N (Speech/Noise) ratio would be lower due to the addition of noise, and partly because persons suffering from tinnitus often also suffer from a reduced ability to understand speech in noise as compared to people with normal hearing.

For many people, the known maskers will not provide any long term relief of tinnitus. Recent research conducted by Del Bo, Ambrosetti, Bettinelli, Domenichetti, Fagnani, and Scotti "Using Open-Ear Hearing Aids in Tinnitus Therapy", Hearing Review, August 2006, has indicated that better long term effects for tinnitus relief may be achieved if so-called habituation of tinnitus is induced in a tinnitus sufferer by using sound enrichment by sound from the ambient environment. The rationale behind habituation relies on two fundamental aspects of brain functioning: Habituation of the reaction of the limbic and sympathetic system, and habituation of sound perception allowing a person to ignore the presence of tinnitus. While tinnitus maskers emit sounds that either partly or completely cover the perceived sound of tinnitus, Del Bo, Ambrosetti, Bettinelli, Domenichetti, Fagnani, and Scotti suggest the use of environmental sounds amplified by a hearing aid or by application of artificial sounds, such as band limited noise. According to an aspect of some embodiments, the hearing instrument also includes a tinnitus relieving circuit, for example generating sounds useful for relieving tinnitus as described above. The relieving circuit may for example be a tinnitus masker, a sound enrichment circuit, etc.

According to another aspect of some embodiments, a tinnitus relieving device or a tinnitus therapy device is provided with a housing and an elongate member as disclosed throughout the present disclosure. The tinnitus relieving device may not have a microphone. In one embodiment, the tinnitus relieving device does not compensate for a hearing loss.

In another embodiment, a hearing instrument includes a tinnitus relieving device or a tinnitus therapy device.

According to yet another aspect of some embodiments, a noise suppression device is provided with a housing and an elongate member as disclosed throughout the present disclosure. The noise suppression device may not have a microphone. In one embodiment, the noise suppression device does not compensate for a hearing loss.

In another embodiment, a hearing instrument includes a noise suppression device.

The noise suppression device may have a conventional noise suppression circuit with a signal processor for performing analysis of the waveform of the background aural or non-aural noise, and generation of a polarisation reversed waveform to cancel the background noise out by interference. The generated waveform has identical or directly proportional amplitude to the waveform of the original noise, but its polarity is reversed. This creates the destructive interference that reduces the amplitude of the perceived noise.

In accordance with some embodiments, a set of hearing instrument parts includes a trunk part shaped for accommodation in a right ear canal or a left ear canal of a user, an elongate member having a first end and a second free end, a left ear connector configured to be attached to the trunk part and to be attached to the first end of the elongate member, wherein when the left ear connector is attached to the trunk part and the first end of the elongate member, the elongate member forms a first angle with a longitudinal extension of the trunk part, the first angle being suitable for a left ear of the user, and a right ear connector configured to be attached to the trunk part and to be attached to the first end of the elongate member, wherein when the right ear connector is attached to the trunk part and the first end of the elongate member, the elongate member forms a second angle with a longitudinal extension of the trunk part, the second angle being suitable for a right ear of the user, wherein the elongate member is configured for connection with a selected one of the left ear connector and the right ear connector, and for positioning in a pinna for retention of the trunk part in the left ear canal or the right ear canal.

In accordance with other embodiments, a set of hearing instrument parts includes a trunk part that is selectively placeable in a left ear canal or a right ear canal or a user, an elongate member having a first end and a second free end, a left ear connector configured to connect the trunk part and the elongate member to form a first configuration that is suitable for a left ear of the user, and a right ear connector configured to connect the trunk part and the elongate member to form a second configuration that is suitable for a right ear of the user, wherein the elongate member is configured for placement in a pinna for retention of the trunk part in a selected one of the left ear canal and the right ear canal.

DESCRIPTION OF THE DRAWING FIGURES

Figure 2:
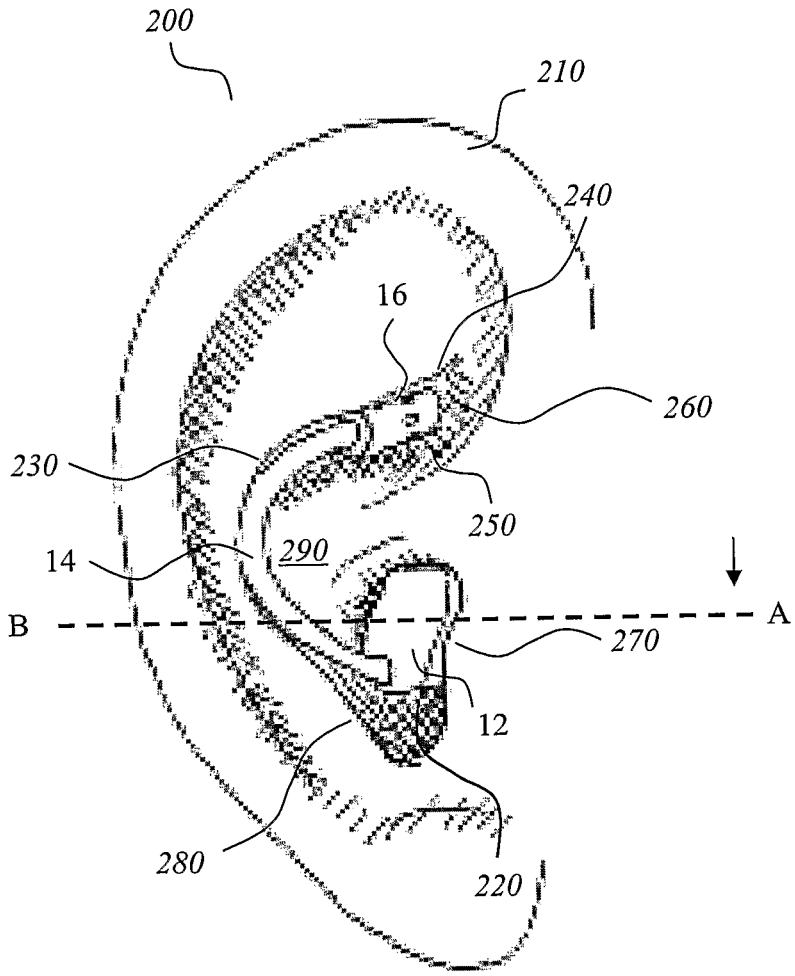
Figure 3:
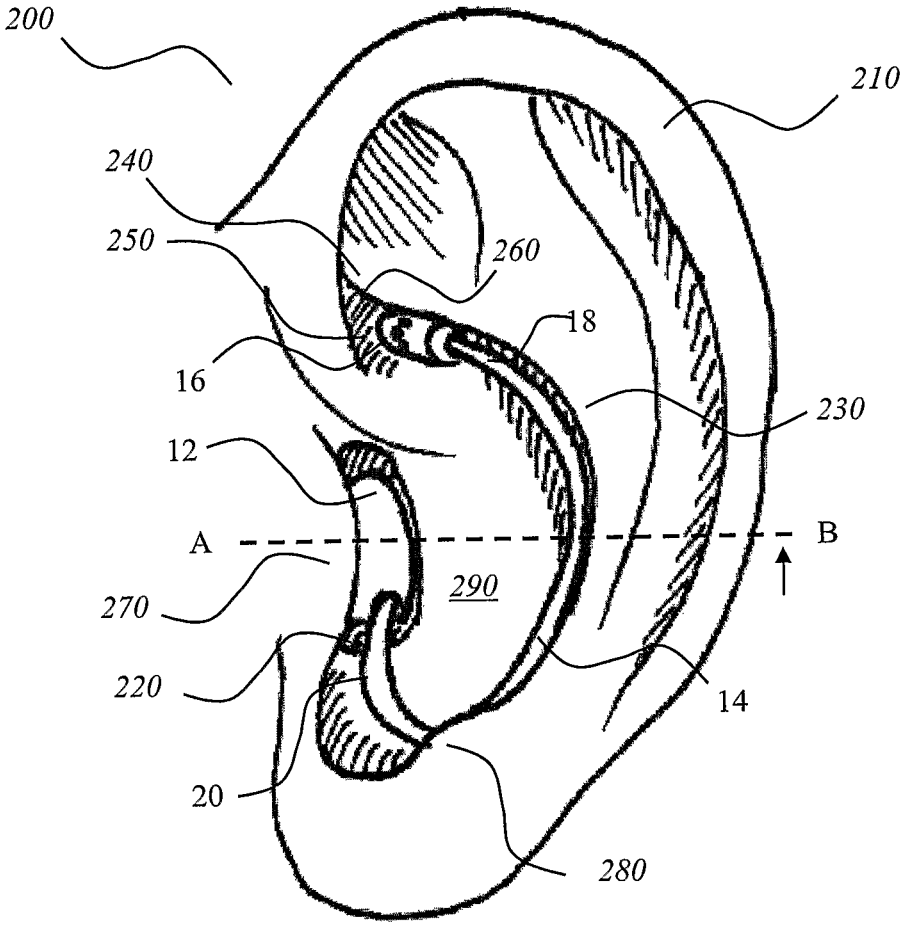
Figure 4:
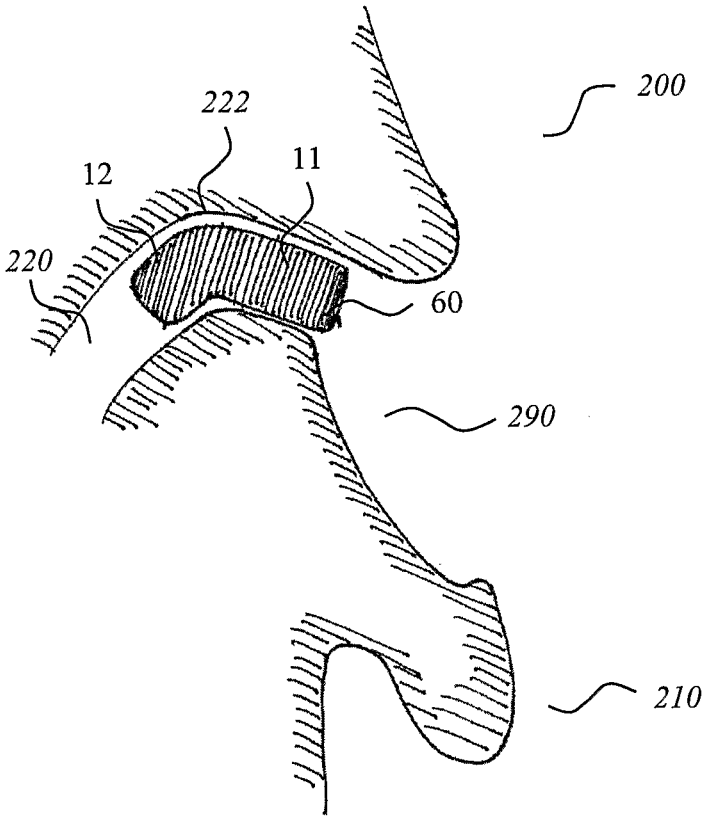
Figure 5:
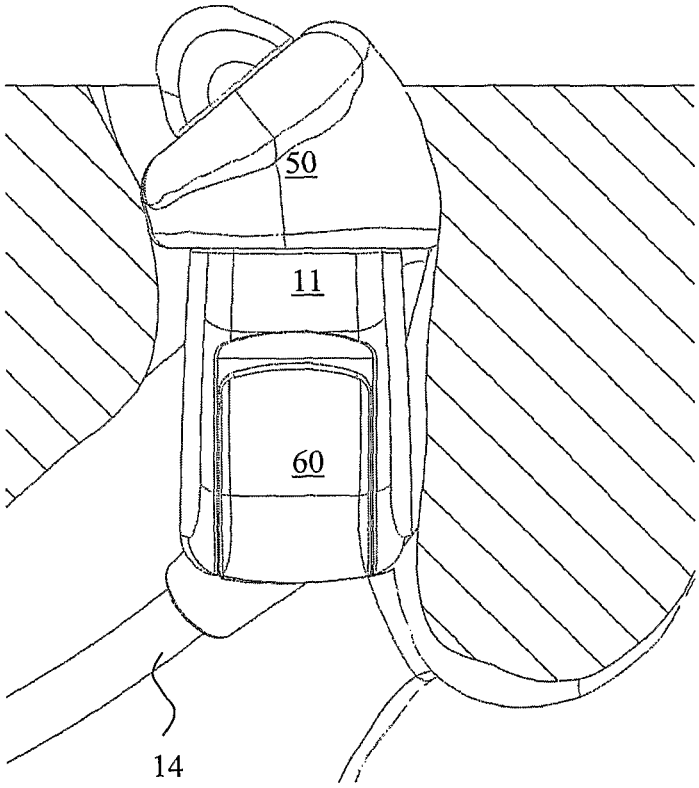
Figure 6:
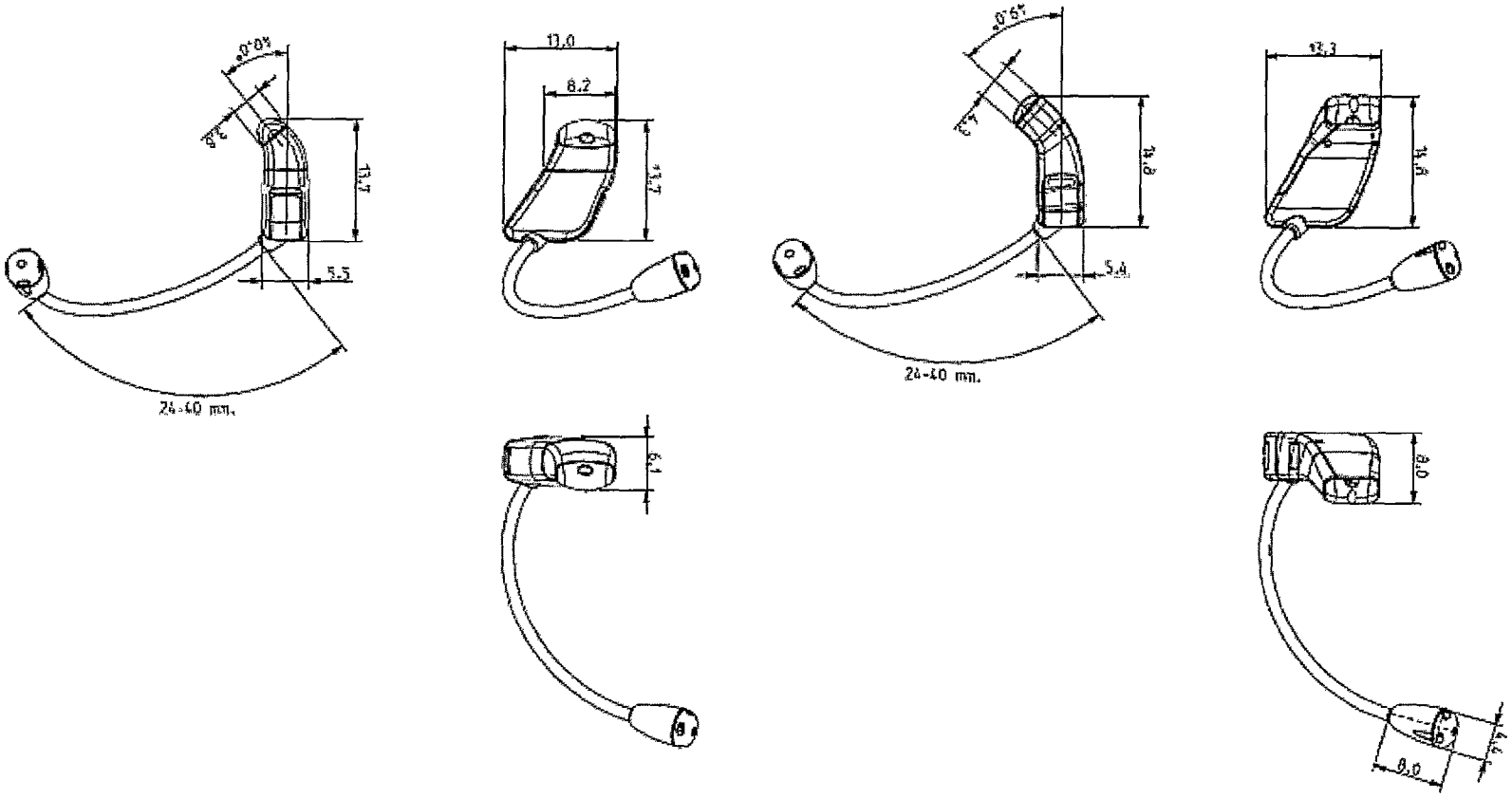
Figure 7:
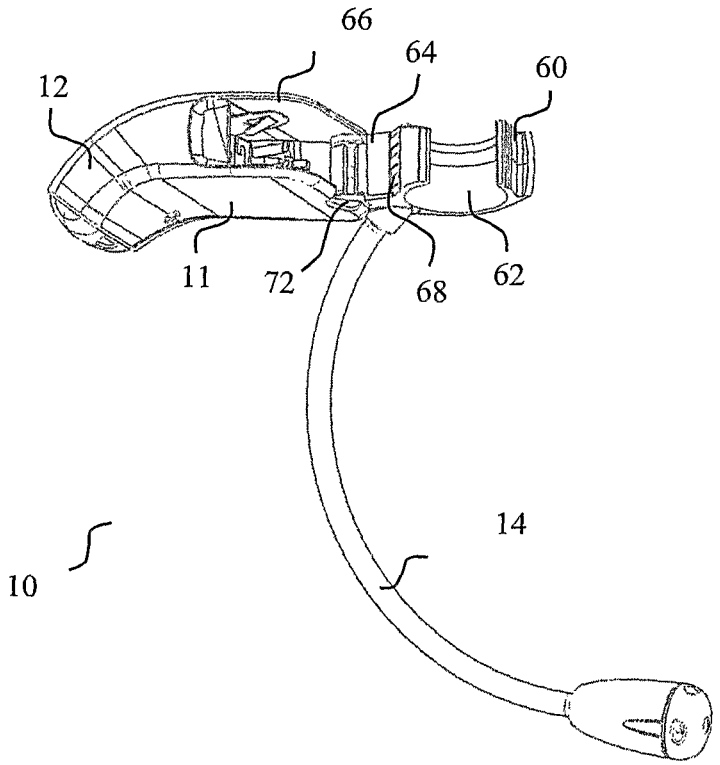
Figure 8:
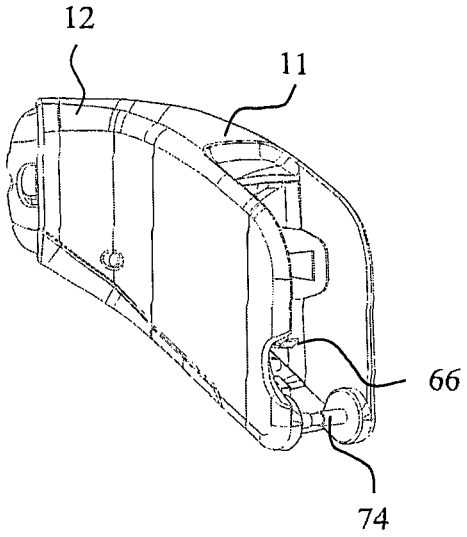
Figure 9:
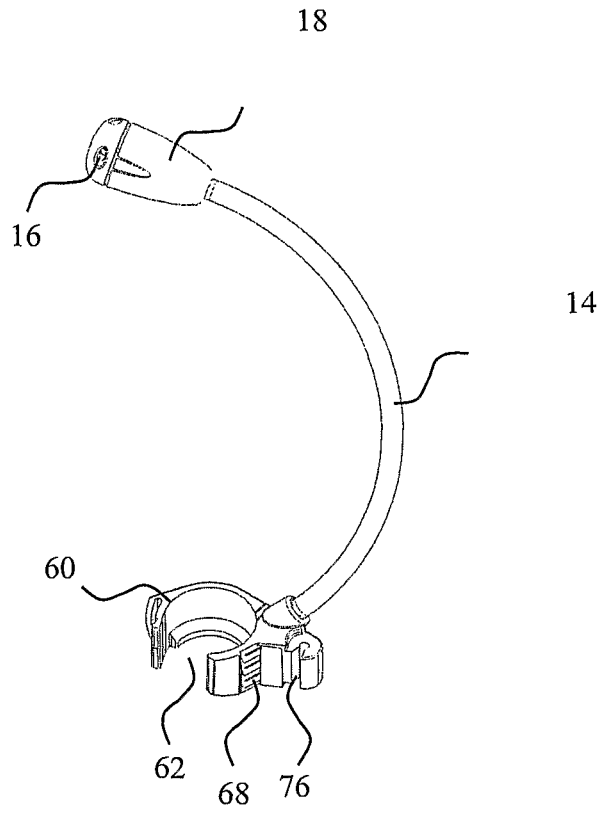
Figure 10:
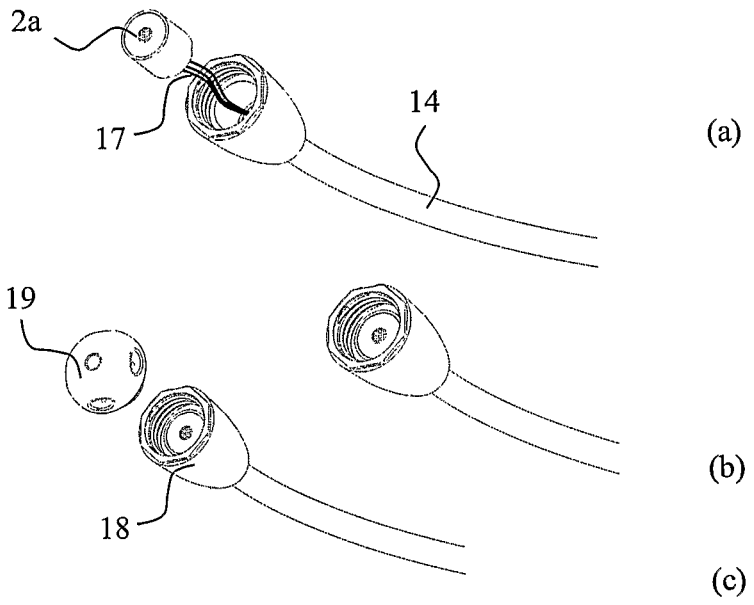
Figure 11:
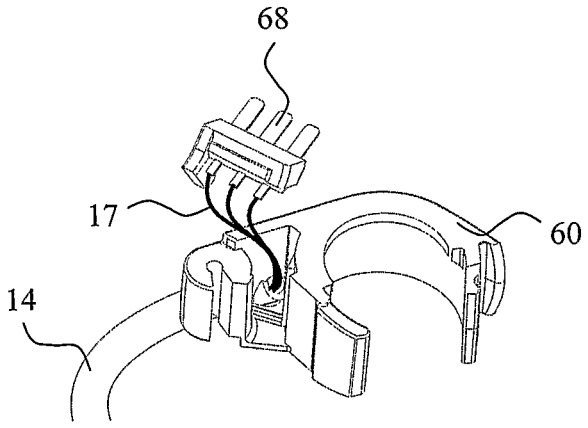
Figure 12:
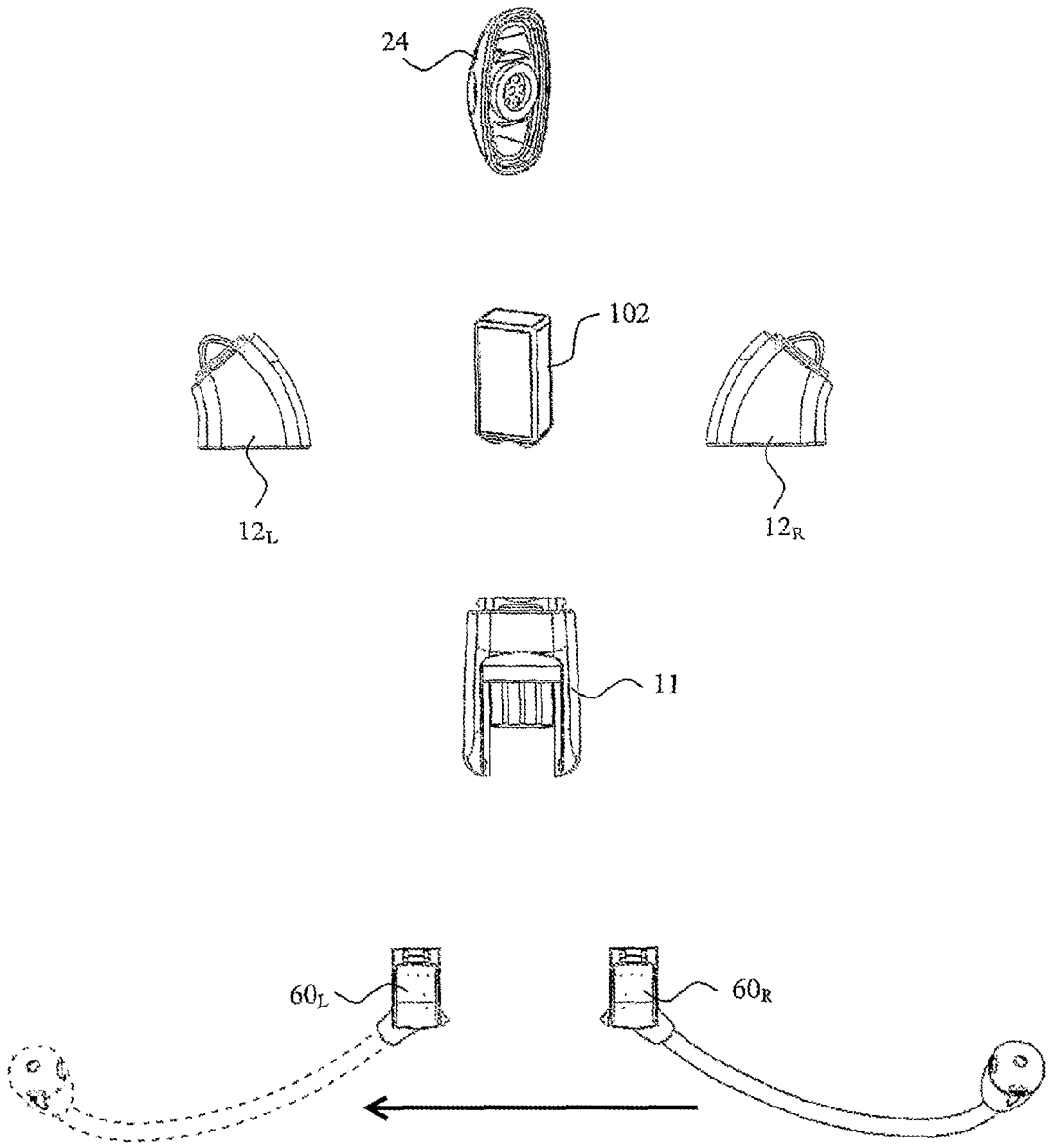
Figure 13:
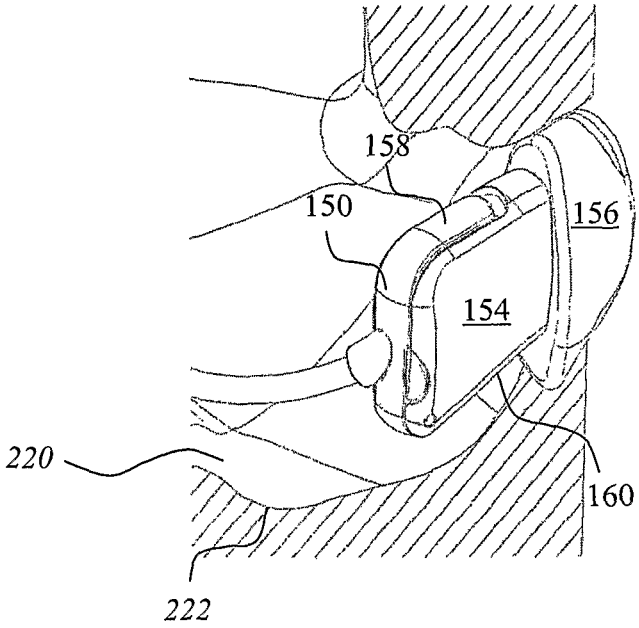
Figure 14:
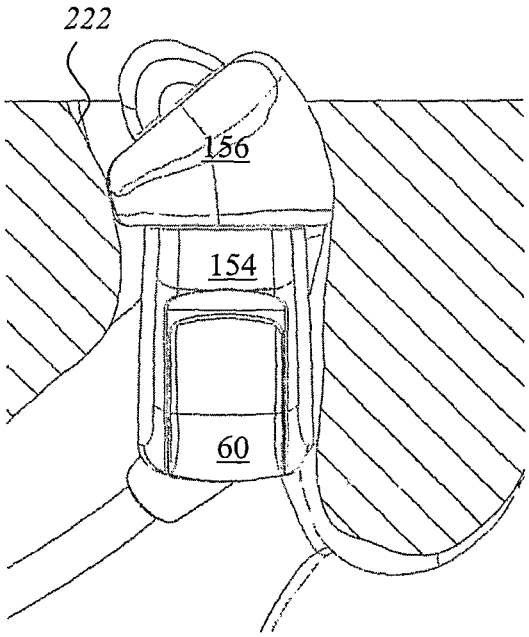
Figure 15:
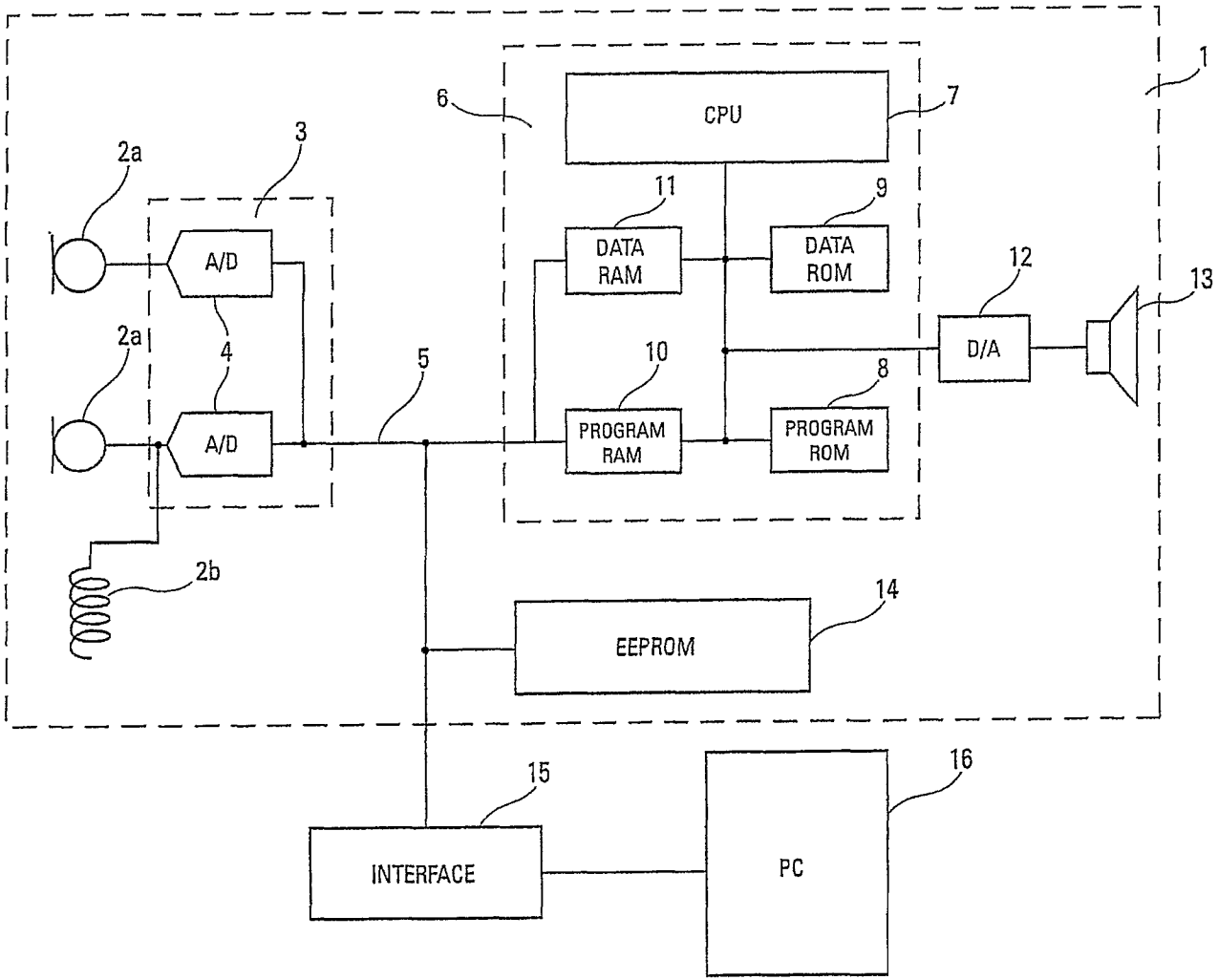
Figure 16:
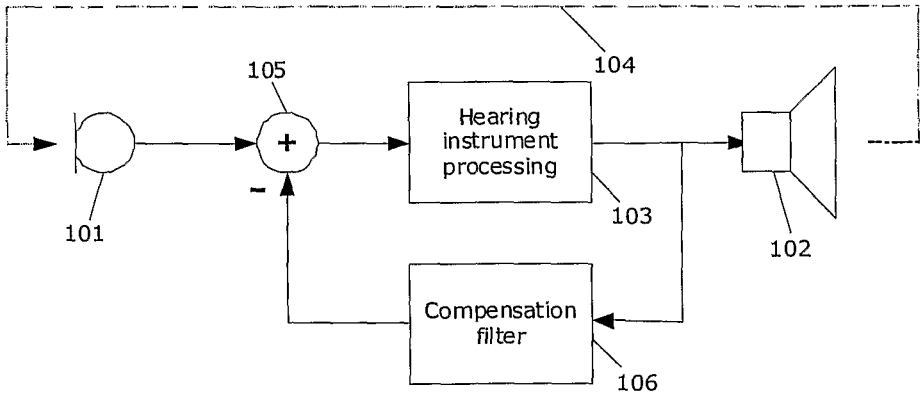

The above and other features and advantages will become more apparent to those of ordinary skill in the art by describing in detail exemplary embodiments thereof with reference to the attached drawings in which:

FIG. 1 is a perspective view of a hearing instrument housing configured for insertion into the right ear canal of a user in accordance with some embodiments, FIG. 2 shows the embodiments of FIG. 1 positioned in the right ear of a user, FIG. 3 shows a hearing instrument housing positioned in the left ear of a user in accordance with some embodiments, FIG. 4 shows a cross-section of the right ear canal of a user seen from above with a hearing instrument housing according to some embodiments inserted in the ear canal, FIG. 5 shows an embodiment with a housing having a custom made part, FIG. 6 shows physical dimensions of two exemplified embodiments, FIG. 7 shows from above the embodiment of FIG. 1 with an open battery door, FIG. 8 shows the trunk part and the tip part of a hearing instrument housing of the embodiment of FIGS. 1 and 5, FIG. 9 shows the elongate member connected to a battery door of the embodiment of FIGS. 1 and 5, FIG. 10 illustrates positioning of a microphone at the second end of an elongate member, FIG. 11 shows a detail of an interconnection between an elongate member and a battery door, FIG. 12 shows a set of hearing instrument housing parts according to some embodiments, FIG. 13 shows in perspective an embodiment with a customized tip inserted in the ear canal, FIG. 14 shows the embodiment of FIG. 13 from above, FIG. 15 shows a simplified block diagram of a digital hearing instrument enclosed in a housing according to some embodiments, and FIG. 16 shows a block diagram of a hearing instrument with one feedback compensation filter.

DESCRIPTION OF THE EMBODIMENTS

The embodiments will now be described more fully hereinafter with reference to the accompanying drawings. The claimed invention may, however, be embodied in different forms and should not be construed as limited to the embodiments set forth herein. Thus, the illustrated embodiments are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. Like reference numerals refer to like elements throughout.

FIG. 1 shows in perspective a hearing instrument housing 10 according to some embodiments. FIG. 2 shows the embodiments of FIG. 1 positioned in the right ear of a user. The illustrated hearing instrument housing 10 has a trunk part 11 and a right tip part 12 fitting into the right ear canal of the user. The right tip part 12 forms an angle towards the left in the medial direction with relation to the longitudinal extension of the trunk part 12 of the housing 10 thereby comfortably fitting the right ear canal 220 for retention of the housing 10 in the right ear of the user. The housing 10 accommodates the hearing instrument components, the tip part 12 of the housing 10 accommodating the receiver (not shown) for emission of sound through an output port (not shown) towards the eardrum of the user.

The illustrated trunk part 11 of the housing 10 is substantially straight along its longitudinal extension and has a substantially rectangular cross-section both perpendicular to and in parallel with its longitudinal extension seen from the side and seen from above.

The housing 10 further comprises an elongate member 14 that is attached to the trunk part 11 of the housing 10 and adapted for positioning within the pinna 200 during use. More specifically, the elongate member 14 is adapted to be positioned in the cimba concha 260 of the ear of the user. The illustrated elongate member 14 and the trunk part 11 of the housing 10 form separate units that are manufactured in separate pieces. The microphone of the hearing instrument is positioned at the microphone input port 16 at the second end 18 of the elongate member 14. The remaining parts of the housing 10 accommodate the other components. Signal conductors extend within the elongate member 14 for electrical interconnection of the microphone with the other components in the housing 10.

Positioning of the microphone(s) of the hearing instrument at the second end 18 of the elongate member 14 provides an increased distance between the microphone(s) and the output port as compared to the corresponding distance in conventional ITE and CIC hearing instruments whereby feedback is diminished.

In the illustrated embodiment, the trunk part 11 and elongate member 14 are manufactured as separate parts that are removably interconnected mechanically and electrically.

The illustrated trunk part 11 of the housing 10 and the elongate member 14 are manufactured in a number of respective standard sizes to fit the human anatomy of the ear of most users. In this way, the manufacturing cost is lowered as compared to the manufacturing cost of customized housings.

As illustrated in more detail in FIGS. 5-7, the elongate member 14 is removably interconnected with the trunk part 11 of the housing 10 so that a large number of different models of the hearing instrument housing 10 may be provided by combining elongate members 14 of different standard sizes with trunk parts 11 of different standard sizes.

The elongate member 14 is adapted to be positioned in the concha of the pinna 200 of the user and has a longitudinal shape with a first end 20 attached to the trunk part 11 of the housing 10 and an opposite second end 18.

The elongate member 14 assists in retaining the housing 10 in the ear canal 220 of the user so that the housing 10 remains securely in place in the ear canal 220 without falling out of the ear. Retention is provided without causing pain to the user. Retention of the device in the proper place is important. Jaw movements during chewing for instance can exert outward forces on the housing 10 of the hearing instrument. The elongate member 14 counteracts this force thereby sufficiently securing the housing 10 from outward motion.

The illustrated elongate member 14 is resilient in a direction perpendicular to the longitudinal extension thereby providing further retention capability of the housing 10 in the ear canal 220 of the user. During positioning of the housing 10 in its intended position in the ear canal 220 of the user, the transverse resilience of the elongate member 14 facilitates insertion of the housing 10 into the ear canal 220 of the user.

The elongate member 14 is adapted to abut the antihelix 230 and extend to the inferior crus 250 of the antihelix so that the second end 18 is positioned at the cimba concha 260 of the ear below the triangular fossa when the hearing instrument housing 10 is positioned in the ear of the user.

The elongate member 14 has a larger cross-section at the second end 18 accommodating the microphone than a remaining part of the elongate member 14 extending therefrom and towards the first end 20.

The elongate member 14 may accommodate further electrical hearing instrument components.

The illustrated elongate member 14 is substantially rigid in the direction of its longitudinal extension so that electrical conductors residing in the elongate member 14 are protected against breaking.

With a microphone in the elongate member 14 at its second end 18 that is positioned at the cimba concha 260 of the ear below the triangular fossa, localisation is substantially maintained since the microphone is positioned at a location within the pinna 200 wherein the received sound signal enables the user to perceive direction towards a sound source from the signal transmitted to the ear drum of the user by the hearing instrument.

Two microphones may be accommodated at the second end 18 of the elongate member 14 for provision of noise suppression and/or further directionality.

The elongate member may further be adapted to abut part of the concha at the antitragus 280 when the housing 10 has been inserted in the ear canal 220 thereby applying a force to the housing 10 towards the ear canal retaining the housing 10 in a position in which the housing 10 is pressed against an anatomical feature within the ear canal.

The illustrated embodiment further comprises a cerumen filter 24 that is fitted on the tip part 12 of the housing 10. The cerumen filter 24 is coupled to the tip part 12 by means of a snap fit coupling.

FIG. 3 shows an embodiment of a hearing instrument positioned in the left ear of a user. The illustrated hearing instrument may have all of the features of the hearing instrument shown in FIGS. 1 and 2.

FIG. 4 shows in horizontal cross-section the positioning of the hearing instrument housing 10 of FIGS. 1 and 2 in the right ear canal 220 of a user. The cross-section of FIG. 4 is taken along line AB in FIG. 2. The viewing direction is from above as indicated by the arrow in FIG. 2. Seen from above and in the medial direction, i.e. from the entrance of the ear canal towards the ear drum, the tip part 12 of the housing 10 forms an angle towards the left in relation to the longitudinal extension of the trunk part 11 facilitating accommodation of the housing 10 in the right ear canal 220 of the user.

Preferably, the tip part 12 is flexible for variation of the angle for accommodation of the housing 10 to varying angles of different users. Preferably, the housing 10 is flexible for comfortable accommodation of the housing 10 in the ear canal of the user providing a high level of comfort.

The illustrated housing 10 has a cross-section that is smaller than the cross-section of the ear canal 220 so that occlusion is reduced or eliminated. When the housing 10 is inserted into the user's ear canal 220, the smaller cross-section of the housing allows communication between the ear canal between the eardrum and the housing 10 and the surroundings for prevention of occlusion. The illustrated hearing instrument housing 10 is positioned completely in the ear canal of the user like a conventional CIC hearing aid. When the hearing instrument housing 10 is properly inserted into the ear canal of the user, the outward pointing end of the hearing instrument housing 10 with the battery door 60 is aligned with, or approximately aligned with, the cavum conchae 290, i.e. the battery door 60 coincides with, or approximately coincides with, the delimitation between the cavum conchae and the ear canal. Preferably, the battery door 60 resides slightly inside the delimitation between the cavum conchae and the ear canal so that the entire housing 10 is accommodated within the ear canal of the user.

FIG. 5 shows a hearing instrument housing 10 according to some embodiments, having a custom made part 50 that fit around a standard sized tip part 12 for improved individual fitting of the standard sized housing 10 to a specific user's ear canal.

Alternatively, a flexible part (not shown) fitting around a standard sized tip part may substitute the custom made part 50 for improved fitting of the housing 10 to a specific user's ear canal. The flexible part may be provided in a number of standard sizes.

As another alternative, the tip part 12 may be customized to fit the ear canal of the user.

FIG. 6 shows the physical dimensions of two exemplified embodiments.

FIG. 7 shows from above the embodiment of FIG. 1 with an open battery door 60. The battery door 60 is provided at the lateral end of the trunk part 11 of the housing 10 pointing out of the ear canal when the hearing instrument housing 10 is positioned in the ear. The battery door 60 has a compartment 62 accommodating the hearing instrument battery (not shown). The user may open or close the battery door 60 by rotating the battery door around an axis of rotation provided by a hinge connection 72. The battery compartment 62 swings out of the trunk part 11 of the housing 10 when the battery door 60 is opened whereby the battery may be exchanged with a new battery.

The elongate member 14 is attached to the battery door 60 and the battery door 60 is removably attached to the trunk part 11 of the housing 10 with a connector 64 including the hinge connection 72. In the illustrated embodiment, the hinge connection 72 has a shaft 74, and the battery door 60 has a flexible recess 76 so that a person may attach the battery door 60 to the trunk part 11 by pressing the recess 76 around the shaft 74 whereby the recess 76 expands slightly to accommodate the shaft 74 and snaps back for retention of the shaft within the recess. Likewise, the user may remove the battery door 60 from the trunk part 11 by pulling the battery door 60 away from the trunk part 11 whereby the recess expands to release the shaft and snaps back into its original relaxed shape upon release of the shaft 74. The illustrated snap fit coupling for interconnection of the battery door 60 with the trunk part 11 is designed so that the force required to separate the battery door 60 from the trunk part 11 is larger than the force required to pull the hearing instrument housing 10 out of the ear canal of the user by pulling the elongate member 14.

The illustrated hearing instrument housing 10 connector 64 further comprises resilient electrical contact members 66 for electrical interconnection of signal conductors in the elongate member 14 with electrical components in the housing 10.

FIG. 8 shows the hearing instrument housing 10 with the battery door 60 removed, and FIG. 9 shows the removed battery door 60 with the elongate member 14.

It is an important advantage of the illustrated embodiment that electrical contact members 68 of the interconnected battery door 60 and elongate member 14 mating the contact members 66 of the hearing instrument housing 10 connector 64 connect slidably with respective electrical contact members 66 of the trunk part 11 when the battery compartment 62 is closed by rotation. The sliding connection provides a cleaning action thereby cleaning the contact surfaces maintaining a low contact resistance across the electrical interconnection of the hearing instrument components, e.g. by mechanical removal of oxide film formed on the contact surfaces, or mechanical removal of other undesired deposits on the contact surfaces.

In another embodiment, the elongate member 14 is removably connected directly with the trunk part 11 of the hearing instrument housing 10. In this embodiment (not shown), the elongate member 14 has an electrical connector at its second end mating a corresponding hearing instrument housing 10 connector. The elongate member 14 with the connector is inserted through a hole provided in the hearing instrument housing 10. The battery door 60 may be provided with a suitable mechanical member that assists in attaching the elongate member 14 to the trunk part 11 of the hearing instrument housing 10 by abutment with the elongate member 14 when the battery door 60 is closed. The battery door may include locking means preventing the battery door from being inadvertently opened e.g. due to forces applied to the elongate member 14.

FIGS. 10 (*a*)-(*c*) illustrate positioning of a microphone 2*a* at the second end 18 of an elongate member 14 in accordance with some embodiments. As shown in FIG. 10 (*a*), the microphone 2*a* and its signal conductors 17 are inserted into the elongate member 14 through an open second end 18 of the elongate member 14, and the microphone 2*a* is pushed into its desired position shown in FIG. 10 (*b*). The signal conductors 17 with the signal line of the microphone 2*a* extend inside the elongate member 14. Finally, a threaded cap 19 with a dirt filter closes the opening of the elongate member 14 as illustrated in FIG. 10 (*c*). The dirt filter at this position protects the microphone against sweat, dirt, dead cells, etc., from the pinna. A cerumen filter may be used as the dirt filter.

FIG. 11 illustrates the interconnection of the signal conductors 17 with the contact members 68 in accordance with some embodiments. In the illustrated embodiment, the contact members 68 are provided on a slide member that may slide into a mating compartment in the battery door for positioning of the contact members 68 as for example illustrated in FIG. 9. Upon insertion of the microphone 2*a* and the signal conductors 17 into the elongate member 14, the exposed ends of the signal conductors 17 or soldered onto the contact members 68 provided on the slide member. Subsequently, the slide member is inserted into the battery door 60 and possibly glued to the battery door.

FIG. 12 shows a set of hearing instrument housing 10 parts according to some embodiments. The set comprises a trunk part 11 configured for interconnection with a tip part $\mathbf{12}_R$, $\mathbf{12}_L$ and that is substantially straight along its longitudinal extension. Further, the set comprises a right tip part $\mathbf{12}_R$ that forms an angle facilitating accommodation in the right ear canal of the user, and a left tip part $\mathbf{12}_L$ that forms an angle facilitating accommodation in the left ear canal of the user of a hearing instrument housing 10. A straight tip part (not shown) that is straight and extends along the longitudinal extension of the trunk part when interconnected with the trunk part may also be provided.

The illustrated set of hearing instrument housing 10 parts further comprises a receiver 102 and a cerumen filter 24, and a left ear battery door $\mathbf{60}_L$ to be removably attached to the trunk part 11 of the housing 10 and attached to the elongate member 14 at an angle suitable for use in the left ear, and a right ear battery door $\mathbf{60}_R$ removably attached to the trunk part 11 of the housing 10 and attached to the elongate member 14 at an angle suitable for use in the right ear.

Each of the parts illustrated in FIG. 12 may be manufactured in a variety of standard sizes and shapes whereby a large variety of housings may be provided based on combinations of a relatively few number of standard sized and shaped parts. In this way, the dispenser will be able to offer users a large variety of housings in an economical way that does not require purchase and storage of a large number of different housings.

FIG. 13 is a side view of a hearing aid housing 150 according to some embodiments mounted in the ear canal 220 of a user. The hearing aid housing 150 comprises a standard sized trunk part 154 that may fit several somewhat different ear canals. The hearing aid housing 150 also comprises a customized tip part 156 that is individually made to fit to the ear canal 220 of a specific user. The customized tip part 156 may be manufactured on the basis of an impression of the ear canal of the user in question and using standard SLA and/or SLS techniques. The illustrated customized tip part 156 accommodates a receiver. It should be noted in FIG. 13 that there are passageways between the top part 158 and lower part 160, respectively, of the trunk part 154 and the ear canal wall 222. This makes the hearing aid housing 150 much more comfortable to wear than conventional CIC or ITE hearing aid housings. Part of an elongate member 164 attached to the trunk part 154 is also shown. The elongate member 164 is adapted for retaining the hearing aid housing 150 in the ear canal of the user. The illustrated elongate member 164 is resilient and tends to revert to its original shape upon deformation. The illustrated elongate member 164 is pre-shaped into a C-shape arc. The illustrated elongate member may be adapted to extend from the trunk part 154 rearwardly and downwardly toward the lower part of the concha behind the antitragus and further up toward the inferior crush of the antihelix for positioning of the free end of the elongate member in the cimba concha just beneath the triangular fossa. The elongate member 164 is preferably attached to the trunk part 154 via the battery door (60 in FIG. 13) of the hearing aid housing 150. In a preferred embodiment, the free end of the elongate member 164 is configured to accommodate a microphone (not shown).

FIG. 14 shows a top view of the hearing aid housing 150 of FIG. 13 mounted in the ear canal. In this figure the battery door 60 is shown more clearly. It should be noted that the sides of the trunk part 154 do not touch the ear canal wall 222, or barely touch the ear canal wall 222. This allows the wall of the ear canal to change shape, for example as a result of jaw movement when the user is e.g., smiling, chewing, or talking, without the discomfort that is associated with conventional customized CIC or ITE hearing aids.

During ear canal wall movement, the customized tip part 156 operates to retain the hearing instrument housing 150 in its intended position in the ear canal due to its tight fit with the ear canal wall, and due to the fact that the ear canal wall of deeper parts of the ear canal moves less than the ear canal wall close to the entrance of the ear canal. Thus, the custom tip part 156 is tightly fitted to a relatively stable part of the ear canal wall facilitating retention of the hearing instrument housing 150 in its intended position in the ear canal.

FIG. 15 shows a simplified block diagram of a digital hearing aid according to some embodiments. The hearing aid 401 comprises one or more sound receivers 402, e.g. two microphones 402*a* and a telecoil 402*b*. The analogue signals for the microphones are coupled to an analogue-digital converter circuit 403, which contains an analogue-digital converter 404 for each of the microphones.

The digital signal outputs from the analogue-digital converters 404 are coupled to a common data line 405, which leads the signals to a digital signal processor (DSP) 406. The DSP is programmed to perform the necessary signal processing operations of digital signals to compensate hearing loss in accordance with the needs of the user. The DSP is further programmed for automatic adjustment of signal processing parameters in accordance with some embodiments.

The output signal is then fed to a digital-analogue converter 412, from which analogue output signals are fed to a sound transducer 413, such as a miniature loudspeaker.

In addition, externally in relation to the DSP 406, the hearing instrument contains a storage unit 414, which in the example shown is an EEPROM (electronically erasable programmable read-only memory). This external memory 414, which is connected to a common serial data bus 405, can be provided via an interface 415 with programmes, data, parameters etc. entered from a PC 416, for example, when a new hearing instrument is allotted to a specific user, where the hearing instrument is adjusted for precisely this user, or when a user has his hearing instrument updated and/or re-adjusted to the user's actual hearing loss, e.g. by an audiologist.

The DSP 406 contains a central processor (CPU) 407 and a number of internal storage units 408-411, these storage units containing data and programmes, which are presently being executed in the DSP circuit 406. The DSP 406 contains a programme-ROM (read-only memory) 408, a data-ROM 409, a programme-RAM (random access memory) 410 and a data-RAM 411. The two first-mentioned contain programmes and data which constitute permanent elements in the circuit, while the two last-mentioned contain programmes and data which can be changed or overwritten.

The housing 10 of the illustrated hearing aid accommodates the above-mentioned hearing aid components except the microphone in a way similar to the housing of a CIC hearing aid. The elongate member accommodates the microphone, e.g. at its second end, and signal conductors extend within the elongate member for electrical interconnection of the microphone with the components in the hearing aid housing. The receiver is accommodated in the tip part of the housing.

Typically, the external EEPROM 414 is considerably larger, e.g. 4-8 times larger, than the internal RAM, which means that certain data and programmes can be stored in the EEPROM so that they can be read into the internal RAMs for execution as required. Later, these special data and programmes may be overwritten by the normal operational data and working programmes. The external EEPROM can thus contain a series of programmes, which are used only in special cases, such as e.g. start-up programmes.

A block diagram of an embodiment of a hearing instrument with a feedback compensation filter 106 is shown in FIG. 16. The hearing instrument comprises a microphone 101 for receiving incoming sound and converting it into an audio signal. A receiver 102 converts output from the hearing instrument processor 103 into output sound, which in, e.g., a hearing instrument is supposed to be modified to compensate for a users hearing impairment. Thus, the hearing instrument processor 103 comprises elements such as amplifiers, compressors and noise reduction systems etc.

A feedback path 104 is shown as a dashed line between the receiver 102 and the microphone 101. Due to the feedback path, the microphone 101 may pick up sound from the receiver 102 which may lead to well known feedback problems, such as whistling.

The (frequency dependent) gain response (or transfer function) H(ω) of the hearing instrument (without feedback compensation) is given by:

$$H(\omega) = \frac{A(\omega)}{1 - F(\omega)A(\omega)} \tag{1}$$

where ω represents (angular) frequency, F(ω) is the gain function of the feedback path 104 and A(ω) is the gain function provided by the hearing instrument processor 103. The feedback compensation filter 106 is adapted to feed a compensation signal to the subtraction unit 105, whereby the compensation signal is subtracted from the audio signal provided by the microphone 101 prior to processing in the hearing instrument processor 103. The transfer function now becomes:

$$H(\omega) = \frac{A(\omega)}{1 - (F(\omega) - F'(\omega))A(\omega)} \tag{2}$$

where F'(ω) is the gain function of the compensation filter 106. Thus, F'(ω) estimates the true gain function F(ω) of the feedback path, the closer H(ω) will be to the desired gain function A(ω).

As previously explained, the feedback path 104 is usually a combination of internal and external feedback paths and acoustical and mechanical feedback paths.

The invention claimed is:

1. A set of hearing instrument parts, comprising:

a trunk part shaped for selective accommodation in a right ear canal or a left ear canal of a user;

an elongate member having a first end and a second free end;

a left ear connector configured to be attached to the trunk part and to be attached to the first end of the elongate member, wherein when the left ear connector is attached to the trunk part and the first end of the elongate member, the elongate member forms a first angle with a longitudinal extension of the trunk part, the first angle being suitable for a left ear of the user; and a right ear connector configured to be attached to the trunk part and to be attached to the first end of the elongate member, wherein when the right ear connector is attached to the trunk part and the first end of the elongate member, the elongate member forms a second angle with a longitudinal extension of the trunk part, the second angle being suitable for a right ear of the user;

wherein the elongate member is configured for connection with a selected one of the left ear connector and the right ear connector, and is configured for positioning in a left pinna or a right pinna for retention of the trunk part in the left ear canal or the right ear canal.

2. The set of hearing instrument parts according to claim 1, wherein the trunk part is substantially straight along its longitudinal extension.

3. The set of hearing instrument parts according to claim 1, wherein each of the left ear connector and the right ear connector is configured to be removably attached to the trunk part.

4. The set of hearing instrument parts according to claim 1, further comprising a battery door, wherein at least one of the left ear connector and the right ear connector is included in the battery door.

5. The set of hearing instrument parts according to claim 1, wherein the trunk part further comprises a connector configured for making electrical contact with a signal line in the elongate member when the elongate member is attached to the trunk part.

6. The set of hearing instrument parts according to claim 1, further comprising:

a right tip part configured to be connected to the trunk part, wherein when the right tip part is connected to the trunk part, the right tip part forms an angle relative to the longitudinal extension of the trunk part, thereby facilitating accommodation of the trunk part in the right ear canal of the user, and a left tip part configured to be connected to the trunk part, wherein when the left tip part is connected to the trunk part, the left tip part forms an angle relative to the longitudinal extension of the trunk part, thereby facilitating accommodation of the trunk part in the left ear canal of the user.

7. The set of hearing instrument parts according to claim 6, further comprising a straight tip part that is straight and extends along the longitudinal extension of the trunk part when connected with the trunk part.

8. The set of hearing instrument parts according to claim 6, wherein one or both of the right tip part and the left tip part is customized for the user.

9. The set of hearing instrument parts according to claim 6, further comprising an additional right tip part, wherein when the additional right tip part is connected with the trunk part, the additional right tip part forms an angle relative to the longitudinal extension of the trunk part that is different from the angle between the right tip part and the longitudinal extension formed when the right tip part is connected with the longitudinal extension.

10. The set of hearing instrument parts according to claim 6, further comprising an additional left tip part, wherein when the additional left tip part is connected with the trunk part, the additional left tip part forms an angle relative to the longitudinal extension of the trunk part that is different from the angle between the left tip part and the longitudinal extension formed when the left tip part is connected with the longitudinal extension.

11. The set of hearing instrument parts according to claim 6, further comprising an additional right tip part and an additional left tip part, wherein the right tip part and the additional right tip part have different respective sizes, and the left tip part and the additional left tip part have different respective sizes.

12. The set of hearing instrument parts according to claim 6, further comprising a receiver in one of the right tip part and the left tip part.

13. The set of hearing instrument parts according to claim 12, wherein the trunk part further comprises a connector for making mechanical and electrical contact with the receiver.

14. The set of hearing instrument parts according to claim 6, further comprising a custom made part fitting around the right tip part or the left tip part for fitting the right tip part or the left tip part to the user's right ear canal or the left ear canal, respectively.

15. The set of hearing instrument parts according to claim 6, further comprising a flexible part fitting around the right tip part or the left tip part.

16. The set of hearing instrument parts according to claim 15, further comprising an additional flexible part, the flexible part and the additional flexible part having different respective sizes.

17. The set of hearing instrument parts according to claim 6, wherein the right tip part is flexible for variation of the first angle formed between the right tip part and the longitudinal extension of the trunk part.

18. The set of hearing instrument parts according to claim 6, further comprising a cerumen filter that is adapted to be fitted on the right tip part or the left tip part with a snap on coupling.

19. The set of hearing instrument parts according to claim 1, wherein the trunk part is customized for the user.

20. The set of hearing instrument parts according to claim 1, further comprising an additional trunk part, the trunk part and the additional trunk part having different sizes.

21. The set of hearing instrument parts according to claim 1, further comprising an additional elongate member, the elongate member and the additional elongate member having different sizes.

22. The set of hearing instrument parts according to claim 1, further comprising a plurality of differently sized receivers.

23. A set of hearing instrument parts, comprising:

a trunk part that is selectively placeable in a left ear canal or a right ear canal or a user;

an elongate member having a first end and a second free end;

a left ear connector configured to connect the trunk part and the elongate member to form a first configuration that is suitable for a left ear of the user; and a right ear connector configured to connect the trunk part and the elongate member to form a second configuration that is suitable for a right ear of the user;

wherein the elongate member is configured for selective placement in a left pinna or a right pinna for retention of the trunk part in a selected one of the left ear canal and the right ear canal.

24. The set of hearing instrument parts according to claim 23, wherein in the first configuration, a longitudinal axis of the trunk part forms a first angle with a portion of the elongate member, and in the second configuration, the longitudinal axis of the trunk part forms a second angle with the portion of the elongate member, the first angle being different from the second angle.

25. The set of hearing instrument parts according to claim 1, wherein the trunk part and the elongate member are configured for use with one of the left ear connector and the right ear connector at a time.

* * * * *